United States Patent [19]

Cooper

[11] 4,200,319

[45] Apr. 29, 1980

[54] SNAP-CLOSING CONTAINER

[76] Inventor: Herbert Cooper, 1 Toms Point La., Port Washington, N.Y. 11050

[21] Appl. No.: 896,307

[22] Filed: Apr. 14, 1978

[51] Int. Cl.[2] ..... A01K 29/00

[52] U.S. Cl. ..... 294/1 BA

[58] Field of Search ..... 294/1 R, 19 R, 25, 55, 294/50.6, 100; 15/104.8, 257.1, 257.6; 206/45.22; 229/32, 33, 35, 36, 41 R, 41 B, 44 R, DIG. 4

[56] References Cited

U.S. PATENT DOCUMENTS

| | | | |
|---|---|---|---|
| 2,585,361 | 2/1952 | Williamson | 206/45.22 |
| 2,804,200 | 8/1957 | Williamson | 229/36 X |
| 3,617,084 | 11/1971 | Mares | 294/50.6 |
| 3,685,088 | 8/1972 | Doherty | 294/1 R X |
| 3,733,098 | 5/1973 | Tobias | 294/19 R |
| 3,857,597 | 12/1974 | Young | 15/257.6 X |
| 4,056,278 | 11/1977 | Bau et al. | 294/19 R |

*Primary Examiner*—Johnny D. Cherry

*Attorney, Agent, or Firm*—Allison C. Collard; Thomas M. Galgano

[57] ABSTRACT

A container for picking up, enclosing, transporting and disposing materials is provided. Such principal material is pet waste. The container is of tray shape comprising two hinged integral face panels disposed in a coextensive planar position in the open condition and in an angular position in the closed condition. In the open position the two hinged panels form a tray surrounded by side and edge panels. The side panels are interrupted at the hinge by triangular webs with the apex of each web at the intersection of the hinge and the side panel. The container is actuated from its stable open traylike condition through a metastable condition to a stable closed triangular clamshell-like configuration. The transition from the open to closed condition is powered by the energy of the folding webs inverting their relative position with respect to their integral sides. The box is formed of resilient sheet materials such as cardboard, polymeric resins and the like, preferably of a biodegradable nature.

10 Claims, 13 Drawing Figures

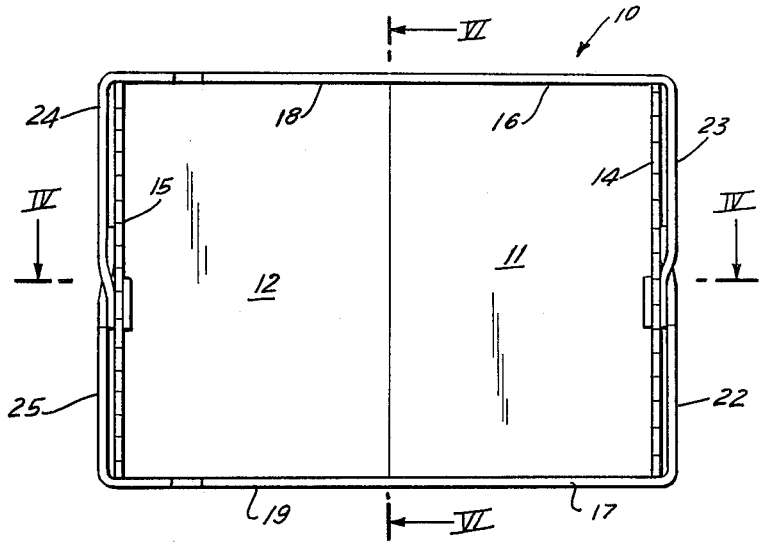
FIG. 5
FIG. 11
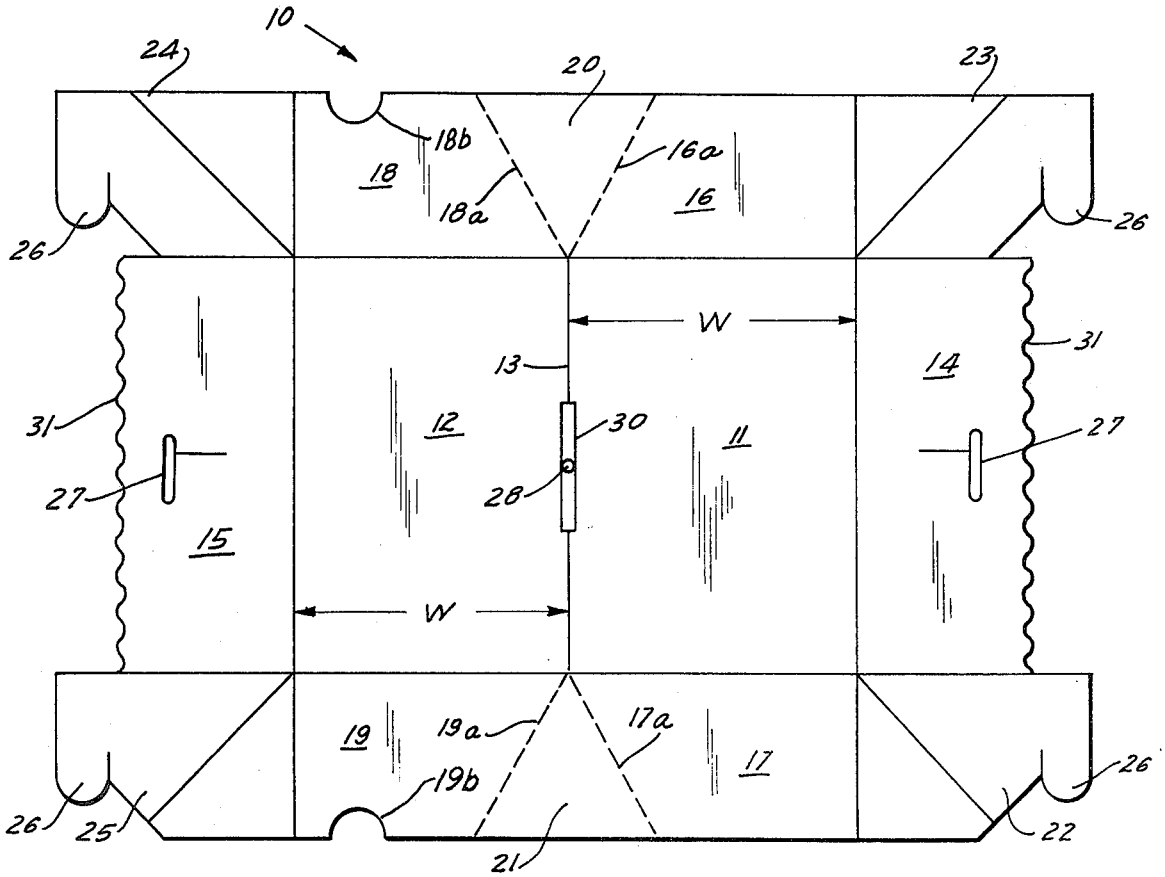

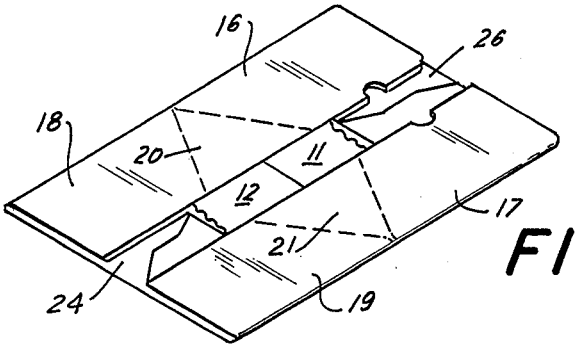
FIG. 13
FIG. 12
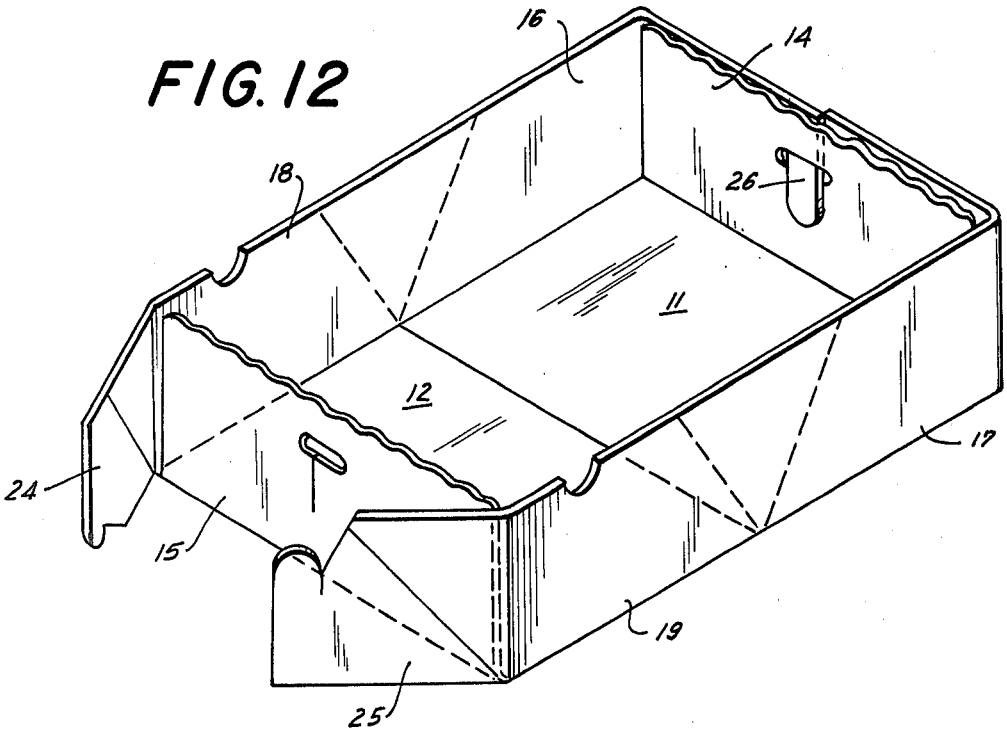
FIG. 6
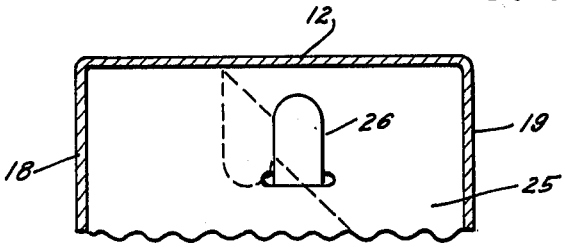

SNAP-CLOSING CONTAINER

FIELD OF THE INVENTION

The present invention relates to a container. More particularly this invention relates to a container assembly particularly adapted for picking up, enclosing and disposing of materials such as pet waste and the like.

BACKGROUND OF THE INVENTION

In most urban areas pet waste fouling the sidewalks and streets has long been regarded as an offensive nuisance. In spite of the fact that many cities have anti-litter laws which require the owners to clean up after their pet, such laws are typically ignored.

The main reason that these laws are ignored or only half-heartedly enforced is that the picking up of the pet waste is, in itself, normally, a very unpleasant task. Thus, even the authorities, who are responsible for enforcement of the anti-litter laws, recognize that they are asking a great deal of the pet owners in requiring them to clean up after their animals.

There are now several methods proposed for cleaning up after pets. One relies on the simple use of an impermeable bag, normally of polyethylene or the like, that the owner places over his or her hand so as to be able to pick up the waste in question, then turns the bag inside out to enclose the waste and then dispose of the waste into an appropriate container. This method has the particular disadvantage that, although the pet waste will not soak through the bag and physically contact the owners hand, the waste can still be plainly felt through the bag. Most persons feel that this tactile sensation makes this procedure simply too disgusting to use.

Another procedure is to use a scooper-shovel, which is basically a special-duty tong-shovel combination (U.S. Pat. No. 3,879,079) used to scoop the pet waste. This method has the disadvantage that the naked waste must then be dropped into the litter basket or disposal container, merely moving the offensive material from one location to another and thereby making emptying of the litter container a task which is more offensive than it would normally be. Furthermore, the scooper itself then must be painstakingly cleaned after each use or the user must carry home the fouled scooper.

Disposable shovels and pushers of cardboard have also been proposed. (U.S. Pat. No. 4,017,015) These also require two hands to operate.

I am the co-inventor of U.S. Pat. No. 3,823,970. This invention, is an improvement thereon.

All previous schemes require the use of both hands for optimum operation. Consequently no hand is free for control of the leashed pet.

OBJECTS OF THE INVENTION

It is therefore an object of the present invention to provide an improved system for enclosing and disposing pet wastes and the like.

Another object is to provide a container which is particularly adapted for pet waste disposal which overcomes the above listed disadvantages by providing a one-hand operation, thus freeing the other hand for control of the pet.

Still another object is to provide a container that, in addition to picking-up, enclosing and locking pet waste, scrapes residues thereof from the surface.

Yet another object is the provision of a novel container which, in addition to being usable to pick up and dispose of pet waste, can also be advantageously employed in other contexts.

SUMMARY OF THE INVENTION

These objects are attained according to the present invention in a container which is so constructed that it normally assumes an outwardly open shape, but which can easily be closed, virtually snapped shut, into a closed shape around the solid waste or other material that the user wishes to contain. In both the open and closed conditions the container according to this invention is completely stable so that it will not open when closed or close when open unless it is displaced through a metastable intermediate position in which it will not remain.

Particularly, according to this invention, the container has a pair of generally similarly dimensioned face panels, each having an inner edge joined to and forming a hinge line with the inner edge of the other panel, an outer edge generally parallel to and spaced from this hinge line, and a pair of generally parallel side edges, each extending between the respective inner and outer edges. A pair of normally generally parallel side panels extend transversely from each of the face panels with each side panel extending from a respective side edge of the respective face panel. An end panel extends transversely from each of the outer edges of each of the face panels in the same direction as the respective side panels and is generally fixed to the side panels of the respective face panel. These face panels are foldable at the hinge line between an open position with the face panels, generally coplaner or at an obtuse angle and the end panels spaced from each other; and a closed position, with the face panels at an acute angle to each other, the edges of the end panels generally meeting, and the side panels overlapping. Finally a web is provided at each end of the hinge line. Each web, triangular in shape, has a pair of non-parallel edges integral with and joined to the respective side panels. On displacement of the face panels between the above-described open and closed positions, the webs move with limited non-permanent deformation of themselves and of the side panels from a position generally transverse to the hinge line and parallel to the side edges, through a position generally transverse to the hinge line and parallel to the side edges. Thus, in the open position of the container, the webs lie generally coplaner with the respective side panels, but in the closed position, the webs are each parallel to but between the inner ends of the respective side panels, and said face panels form an acute angle with each other.

This container may be combined with means for displacing the outer edges of the face panels toward each other for moving the box or container from the open stable position toward the closed stable position. Thus, the user of the container need merely place it in the open position facing downwardly over the solid waste to be picked up, and then inwardly deflect the two outer edges of the face panels toward each other, through the metastable position, in order to close the container around the solid material and secure the contents therein. The container will then remain in this stable, closed position so that the container can easily be carried to a receptacle for proper disposal.

The webs, in the stable closed position, lock the container shut around the enclosed material.

Such an arrangement has the enormous advantage that the user need not come in even indirect contact with solid waste being picked up. Furthermore, once enclosed within the container the solids can be disposed with the container, and will not foul the litter basket or the like in which it is discarded. Moreover the container unit can be produced at extremely low cost, normally of relatively inexpensive cardboard, which is biodegradable.

According to further features of this invention, the one face panel may be slightly wider in the direction perpendicular to the hinge line than the other face panel and its respective side panels are similarly wider. This allows the side and end panels of the other face panel, which may also be slightly shorter in a direction perpendicular to the hinge line to close slightly within the other panel. This forms an "overbite" which ensures that the material picked up by the container is securely enclosed and will not leak therefrom.

According to yet another feature of this invention the webs and panels are unitarily formed from a single flat piece of rigid material such as cardboard or the like. Each web is generally triangular and has an apex at the respective end of the hinge line. Each of the end and face panels are generally rectangular, therefore, the side panels will be formed as right trapezoids with attached integral triangular webs.

The means for closing the box from the open stable position, through the metastable snapping closure, to the stable closed position may simply be formed in accordance with this invention by a loop, connected at the hinge line, so that the user need merely place a finger through the loop and press downwardly on the outer face of each of the face panels to activate the resilient webs to close the container. This loop may be formed of wire, string, synthetic resin material, or from the cardboard trimmings from the container blanks. The loop, of whatever material, is inserted into position either through appropriate perforations at or adjacent to the hinge line or may be fastened by glueing.

It is also within the scope of this invention to use an activating wand assembly having a grip means or pressure knobs at its end which can engage or press around the outer edges of the face panels, and may also pull upon the loop closure means. The wand can be hollow and the gripper can be rendered closeable by pulling a moveable portion of itself via a retractable member such as a rod or cord into the hollow wand so the user need merely pull, for example on the portion of said member projecting from the upper end of the wand, to close the container by the lateral application of pressure via the gripper. Alternatively stabilizing knobs may hold the container in its open position and the ring or lugs pulled upwardly via said wand-enclosed cord. Such an arrangement is particularly useful for people who cannot or do not wish to stoop to snap the container around the intended contents.

It is also completely within the scope of this invention to use the container for other purposes than the disposal of pet waste. For example, the device can readily be used as a fast food container, as it allows convenience of packing and convenient and rapid access to the contents merely by snapping the container from the closed to the open position, and finally provides a convenient receptacle for disposal of food residues, napkins, wraps, and utensils. Indeed such an arrangement can be combined with systems wherein the individual items are normally packed to provide a package that does not need a separate sack or bag. It may be used as a bait box, novel gift box, and if fashioned of water-proof materials as a snap trap. In the open position it may serve as a tray for packaging animal food or similar pet items. The cardboard may be imprinted with advertising matter when used as a packaging tray.

BRIEF DESCRIPTION OF THE DRAWING

FIG. 5 is a view taken in the direction of the arrow V of FIG. 4, along the line IV—IV illustrating the section plane of FIG. 4;

FIG. 6 is a section taken in the direction of line VI of FIG. 5;

FIG. 11 is a plan view of a flattened blank for the container of this invention;

FIG. 12 is a perspective view of the partially assembled container according to this invention;

FIG. 13 is a perspective view of the flattened container according to this invention in compact configuration for storage, shipping or carrying prior to erection and use with its snap-closing action.

SPECIFIC DESCRIPTION

Figure 1:
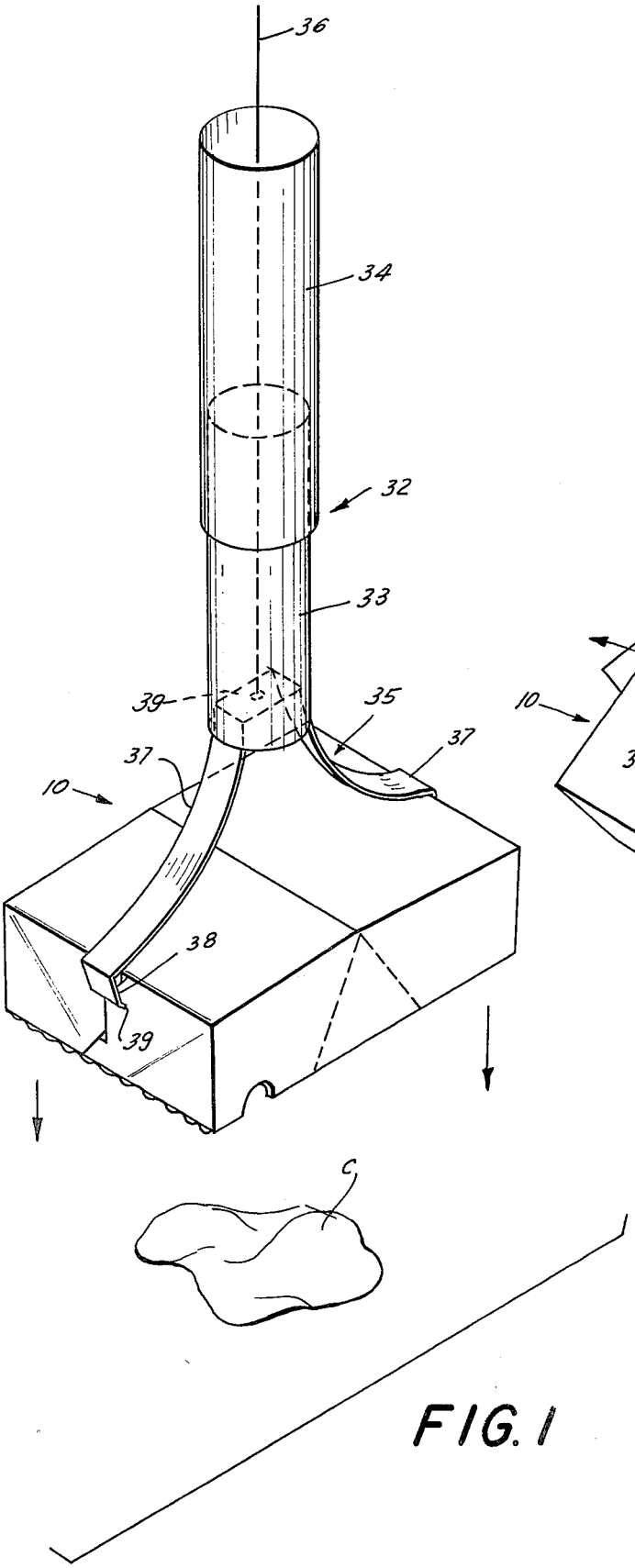
FIGS. 1,2, and 3 are perspective views showing sequential stages in the operation of the snap-closing container of this invention.

With reference at first to FIG. 11, the container 10 of this invention is formed of a single stiffened sheet of coated cardboard and basically comprises a large rectangular face panel 11, a second face panel 12 hinged to panel 11 at hinge line 13, a pair of end panels 14 and 15 at the outer edges of panels 11 and 12, respectively, a pair of edge panels 16 and 17 on panel 11 and a pair of edge panels 18 and 19 on panel 12, a pair of triangular webs 20 and 21 and four corner pieces 22–25. The face panel 11 is preferably of a transverse width W which is slightly greater than the transverse width w of the face panel 12. The difference between the widths W and w is at least equal to about twice the thickness of the material forming the blank from which the container 10 is formed.

The edge panels 16–19 are formed as right trapezoids and web 20 between panels 16 and 18 and the web 21 between webs 17 and 19 are both formed as isosceles triangles. Panels 16 and 18 and web 20 as well as panels 17 and 19 with web 21 are each formed integrally and subdivided by creases **16*a*, 18*a* and 17*a* and 19*a* respectively. Creases or fault lines are formed at the junctions of all panels with all of the other pieces and panels, except that the end panels 14 and 15 are joined only at their inner edges to the respective face panels 11 and 12, being separate from the corner panels 22–25**.

Corner panels 22–25 are formed with central creases terminating at the corners of the respective face panels 11 and 12 so that the entire container can be folded flat as shown in FIG. 13. Moreover the corner panels 22–25, which are all identical may each be formed with a tab 26 that can engage in a slot 27 formed in the respective end panels 14 or 15. The tabs 26 of both of the panels 22 and 23 can engage in the slot 27 of the panels 14 and the tabs 26 of the corner pieces 24 and 25 can engage in the slot 27 of the end panel 15, as best shown by a comparison of FIGS. 6 and 12.

In assembly side panels 18 and 19 should be slightly compressed to ensure that folds 18*a* and 19*a* fold inwardly thus urging folds 16*a* and 17*a* at side panels 16 and 17 outwardly. To assist this folding action and the proper operation of the webs 20, 21, the folds 18*a* and 19*a* are preferably creased inwardly and folds 16*a* and 17*a* are creased outwardly. To identify side panels 18 and 19 for compressing, indents 18*b* and 19*b* are provided.

The webs 20 and 21 in the shape of isosceles triangles with their respective apexes at fold line 13 are the source of the energy urging the container 10, from its open stable to its closed stable position, through its metastable position. The energy is provided by the resilience of the cardboard at the folds 16*a*, 17*a*, 18*a*, 19*a*, and the position of the webs 20 and 21. The position of webs 20 and 21, co-planar with the adjacent sides 16 and 18 and 17 and 19 respectively, maintains the box in its stable open position. The reversal of webs 20 and 21 in the closed position presses and locks container 10 in its stable closed condition.

The angle at the apex of each isosceles triangle is selected on the basis of the desired dimensions of the container in the closed condition. The angle is selected so that the web in the closed condition will position face panels 11 and 12 at substantially the same angle and will result in the meeting of serrated edges 31 on each of end panels 14 and 15. The stiffer the cardboard, the firmer the maintainance of the container 10 in the closed condition. The width of side panels 16–19 controls the volume of the closed container 10 and also area of resilience for webs 20 and 21.

Figure 4:
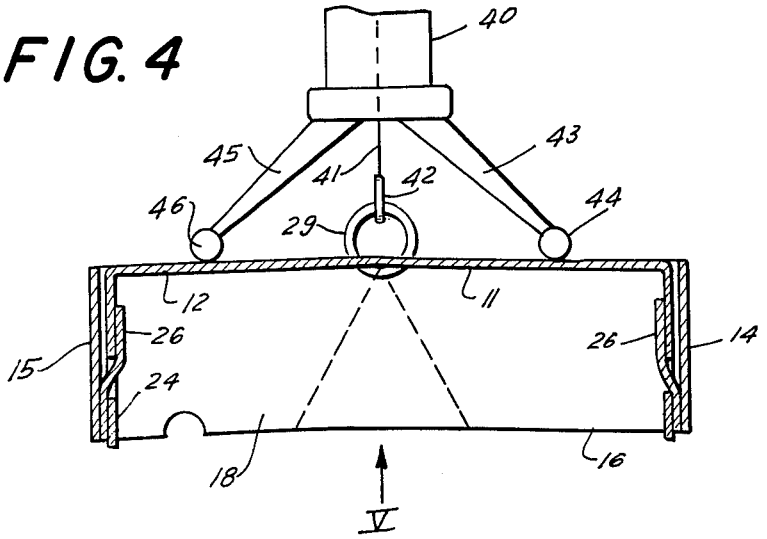
FIG. 4 is a section through the disposable container of this invention.
Figure 9:
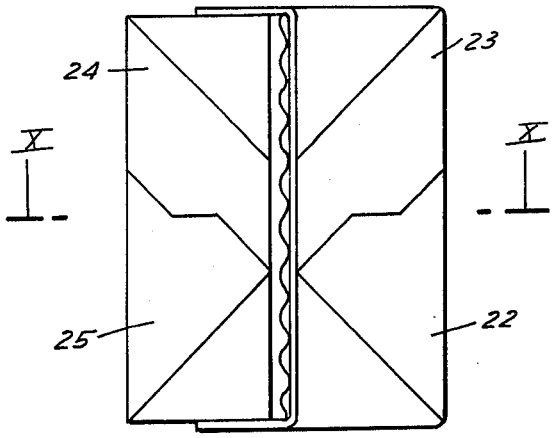
FIG. 9 is a bottom view of the fully closed container according to this invention.
Figure 10:
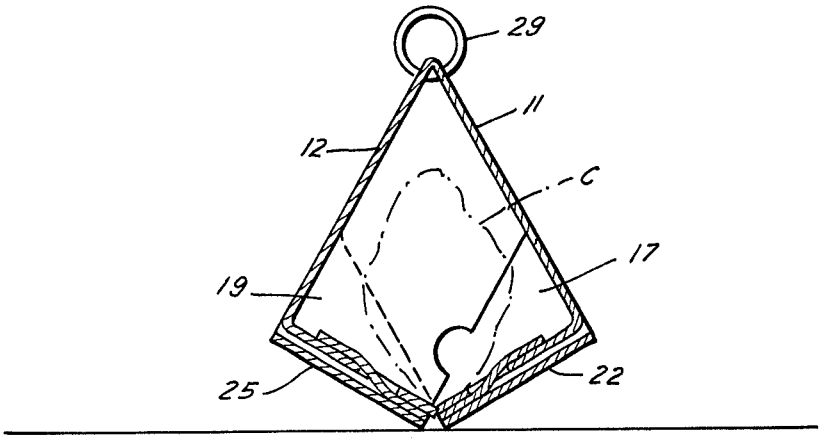
FIG. 10 is a section taken along the line X—X of FIG. 9.

A hole 28 may be formed in the center of hinge seam 13 between panels 11 and 12 for reception of a ring or loop 29 as visible in FIG. 4, with ends or legs 20 of ring 29 extending parallel to and lying on fold line 13 and ring 29 lying perpendicular to the fold line 13 and at the opposite or interior side of the panels 11 and 12. The edges of the end panels 14 and 15 may be formed with serrations 31 that engage together like teeth as seen in FIGS. 9 and 10.

Figure 7:
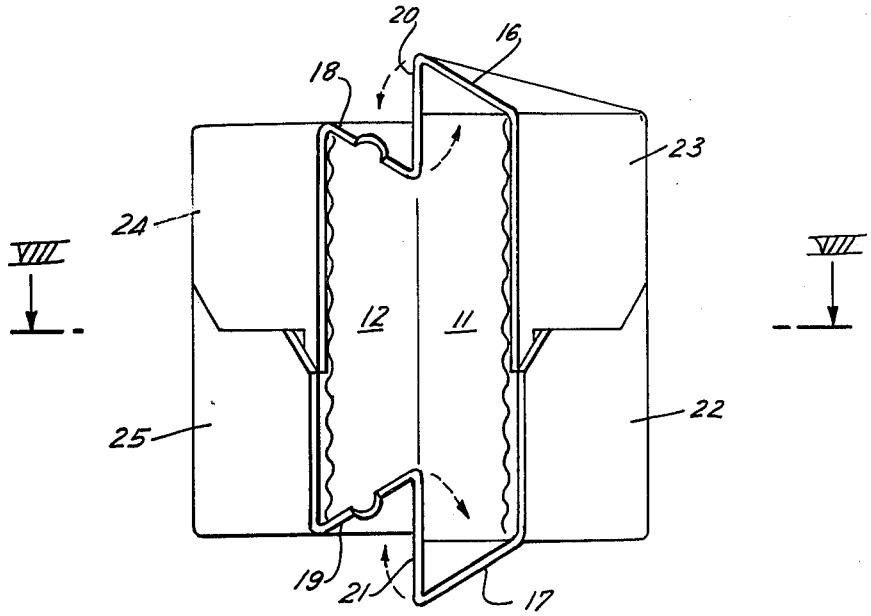
FIG. 7 is a bottom view of the partially closed container according to this invention.
Figure 8:
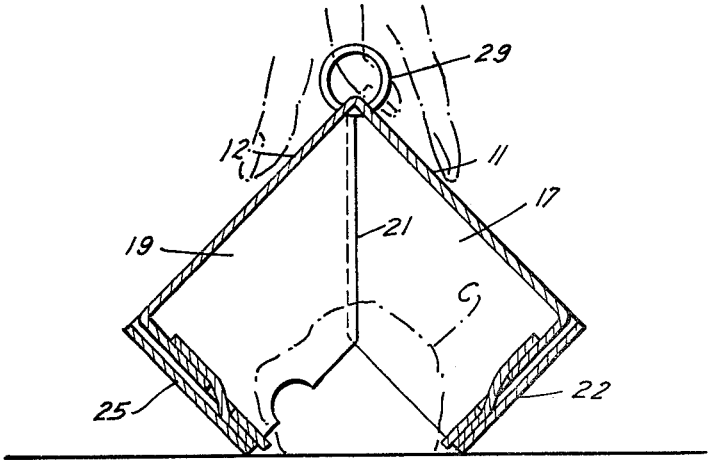
FIG. 8 is a section taken along the line VIII of FIG. 7.

The container according to this invention may be employed with the ring 29 shown in FIG. 4 as an aid in closure of the container. In this usage the user need merely place the index finger through the ring 29 to hold the device completely from the outside of the panel and in the stable open position. The downwardly open box as seen in FIG. 4 can then be placed over the intended contents which the user desires to pick up without touching, and then a combined upward pressure is exerted on the ring while the outsides of the panels 11 and 12 are held down and this springs the box inwardly through the positions shown in FIGS. 7 and 8 into the positions shown in FIGS. 9 and 10, with the contents C enclosed inside. During such closing, reversal of the webs 20 and 21 as best seen in FIG. 7 provides the energy to deform the carton so that the position of FIGS. 7 and 8 can be considered as a metastable position in which the unit cannot remain. Instead once pushed into the position of FIGS. 7 and 8 the container 10 will automatically snap-shut into the stable position of FIGS. 9 and 10, and will remain in this position unless or until forcibly opened. Naturally if the contents C is to be disposed of, the user need merely place closed container 10 into an appropriate litter container.

Figure 2:
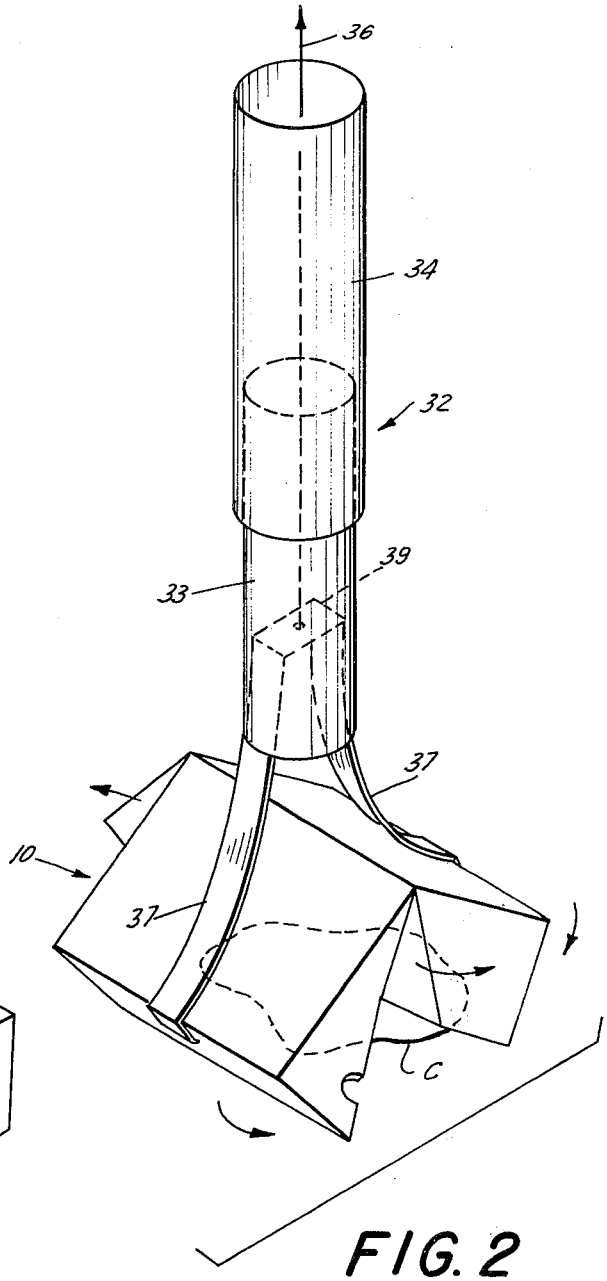
Figure 3:
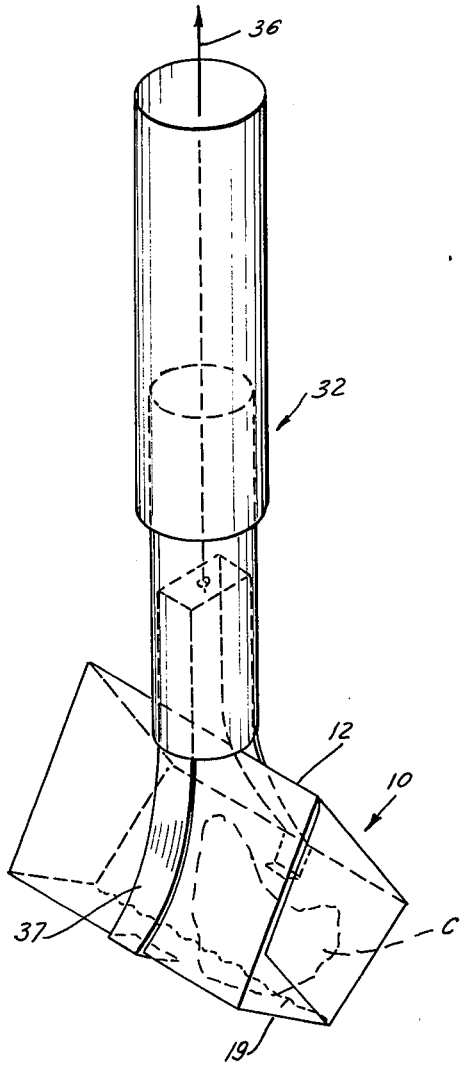

It is also possible in accordance with this invention to use the device in combination with a combined wand and actuating unit 32 such as shown in FIGS. 1–3, or an alternate wand embodiment shown in FIG. 4. The wand and actuating unit 32 comprises a pair of fixed-together wand sections 33 and 34, a spring-steel gripper 35, and an actuating wire 36.

The gripper 35 comprises at least a pair of legs 37 terminating at gripper feet 38 having at the outer end teeth 39. The upper ends of the legs 37 are bridged by a unitary cross-piece 39 having a central hole through which is threaded one end of the actuating wire 36. Crosspiece 39 is dimensioned so that it can fit within the smaller tube section 33. Wand sections 33 and 34 may be telescoping for ease in carrying.

In use, the gripper feet 38 are fitted over the erected container 10 so that the teeth 39 of the one leg 37 engage against the one end panel 15 and the teeth 39 of the other leg 37 against the other end panel 14. The crosspiece 39 is engaged tightly within the tube section 33 and slight tension is maintained on the wire 36 so that the container 10 can be held in the open position as seen in FIG. 1 without being dropped. The user then need merely lower the open container 10 over the contents C and exert a pull on the wire 36 as shown in FIG. 2 to move the container 10 into the above described metastable position. The unit will automatically snap closed as shown in FIG. 3 so that the panels 11 and 12 define an acute angle. The angular configuration of serrated edges 14 and 15 aids in scooping the contents into the container 10 and with slight pressure during closing, actually scrapes the surface upon which the waste C is resting. The user can then simply walk to the nearest litter container, release the tension on wire 36, and shake the full container 10 into the litter basket. As the container 10 is in a stable condition when in its open position such as shown in FIGS. 1, 4, 5, and 6, and is stable in the closed position as shown in FIGS. 3 and 10, solid waste C inside the closed container 10 will not leak therefrom and create an offensive mess. Once again it must be pointed out that in the metastable condition, illustrated in FIGS. 2, 7, and 8, the unit is not stable and will move through such a condition either into the closed or open stable positions and will remain in such a stable configuration. Thus the arrangement according to the instant invention allows a piece of solid waste to be picked up and disposed of in an extremely neat and simple manner. The container 10 can be produced at extremely low cost so that the device is eminently suited for use as a container so that the pet owner can clean up after his or her pet. What is more, the device so-contains the enclosed pet waste that the emptying of the litter basket or other receptacle into which container 10 has been deposited is not likely to soil the person emptying such receptacles.

The invention provides an extremely inexpensive and effective solution to the problem of streets fouled by pet wastes. The cost is nominal and the normally unpleasant task of picking up the pet waste is rendered as inoffensive as possible.

The container may be made in several sizes but it should be noted that the spring action of the webs in the metastable condition compacts and consolidates the intended contents. This adds to the volumetric efficiency of the container.

I claim:

1. A container comprising:

a pair of generally similarly dimensioned face panels each having an inner edge joined to and forming a hinge line with the inner edge of the other panel, an outer edge generally parallel to and spaced from said line, and a pair of generally parallel side edges each extending between the respective inner and outer edges;

a pair of normally generally parallel side panels extending transversely from each of said face panels, each from a respective side edge of the respective face panel;

an end panel extending transversely from each of said outer edges in the same direction as said side panels and generally fixed relative to the side panels of the respective face panel, said face panels being relatively foldable at said line without folding any of the other panels between a stable open position with said face panels generally co-planar and said end panels spaced from each other and a stable closed position with said face panels at an acute angle to each other, said end panels generally meeting, and said side panels overlapping and generally parallel to one another; and a web at each end of said hinge line and having a pair of nonparallel edges joined to the respective side panels, said webs and panels being stiff and uncreased but limitedly deformable and said webs moving with limited nonpermanent deformation of themselves and of said side panels from a position transverse to said line and parallel to said side edges through a position generally parallel to said line into a reversed position transverse to said line, sandwiched between and parallel to said side panels on displacement of said face panels between said open and closed positions.

2. The container defined in claim 1 wherein one of said face panels is slightly wider in a direction perpendicular to said line than the other of said face panels.

3. The container defined in claim 2 wherein said end panel of said one face panel is also slightly wider in a direction perpendicular to said line than the other of said end panels, whereby said end panels can overlap and limitedly fit within each other in said closed position.

4. The container defined in claim 1 wherein said webs are each generally triangular and each have an apex at the respective end of said hinge line.

5. The container defined in claim 4 wherein said side panels are generally shaped as right trapezoids and said face and end panels are generally rectangular.

6. The container defined in claim 1 wherein said face and end panels are generally rectangular.

7. The container defined in claim 1 wherein said end panels have serrated toothed-edges generally parallel to but opposite the respective outer edges.

8. The container defined in claim 1, further comprising means for urging said outer edges together and thereby displacing said container from said open into said closed position.

9. The container defined in claim 8 wherein said means includes a finger loop attachable at said hinge line.

10. The container defined in claim 8 wherein said means includes a wand, a gripper engageable with said outer edges, and means for remotely displacing said gripper for urging said outer edges toward each other.

* * * * *